US006012358A

United States Patent [19]

Lins et al.

[11] Patent Number: 6,012,358

[45] Date of Patent: Jan. 11, 2000

[54] SETTING TOOL FOR SELF-CUTTING UNDERCUT ANCHORS

[75] Inventors: Reinhard Lins, Sevelen, Switzerland; Erich Wisser, Bregenz, Austria; Helmut Gassner, Triesenberg, Liechtenstein; Susanne Kossian, Feldkirch, Austria; Rainer Kussmaul, Thüringen, Austria; Hermann Beck, Feldkirch-Tisis, Austria; Markus Hartmann, Frastanz, Austria

[73] Assignee: Hilti Aktiengesellschaft, Schaan, Liechtenstein

[21] Appl. No.: 08/879,000

[22] Filed: Jun. 19, 1997

[30] Foreign Application Priority Data

Jul. 12, 1996 [DE] Germany ..... 196 28 216

[51] Int. Cl.[7] ..... B25B 9/00

[52] U.S. Cl. ..... 81/13; 81/176.15; 29/264; 29/275

[58] Field of Search ..... 81/176.15, 176.3, 81/125, 124.2, 451, 13, 55, 463, 465, 466; 29/264, 275

[56] References Cited

U.S. PATENT DOCUMENTS

| | | | |
|---|---|---|---|
| 2,377,077 | 5/1945 | Gay et al. | 81/13 |
| 2,381,597 | 8/1945 | Johnson | 81/176.15 |
| 3,050,733 | 8/1962 | Bach | 29/275 |
| 3,489,041 | 1/1970 | Hauenstein et al. | 81/125 |
| 3,822,616 | 7/1974 | Phillips | 81/176.15 |
| 4,836,062 | 6/1989 | LaTorre | 81/13 |

FOREIGN PATENT DOCUMENTS

| | | | |
|---|---|---|---|
| 120163 | 3/1958 | U.S.S.R. | 81/13 |

*Primary Examiner*—David A. Scherbel
*Assistant Examiner*—Joni B. Danganan
*Attorney, Agent, or Firm*—Brown & Wood, LLP

[57] ABSTRACT

A tool for setting self-cutting undercut anchors (6) in boreholes (B) in a receiving material (G) includes anchors (6) formed of an axially extending anchor rod (7) with a conically shaped surface at a leading end of the rod widening in the setting direction, and an axially extending rotatable sleeve (9) laterally enclosing the anchor rod and which is axially displaceable against the conically shaped surface for effecting radially outward spreading of cutting tabs located at the leading end of the sleeve. The cutting tabs form an undercut (U) in the inner surface of the borehole (B) as the sleeve is rotated. The tool has a rotatable propelling part (2) for the sleeve (9) of the undercut anchor (6) and a trailing end (3) of the propelling part is arranged for insertion into a chuck of a rotary hammer drill. The propelling part (2) cooperates with a support element (4) arranged to be supported by the surface of the receiving material (G) in which the borehole (B) is formed. The support element (4) has a receptacle (5) for the trailing end of the anchor rod in which the anchor rod can be axially fixed. The propelling part (2) can be displaced axially relative to the support element.

10 Claims, 3 Drawing Sheets

33
31
32
321
321
35
341
341
38
37
321
36
34
341

SETTING TOOL FOR SELF-CUTTING UNDERCUT ANCHORS

BACKGROUND OF THE INVENTION

A tool for setting self-cutting undercut anchors where the anchors are formed of an anchor rod with a conically shaped surface at the leading end of the rod widening in the setting direction and a rotatable sleeve placed around the anchor rod and having cutting tabs at the leading end of the sleeve which can be spread radially outwardly as the sleeve is driven against the conically shaped surface so that the cutting tabs form an undercut in the wall surface of a cylindrical borehole in a receiving material as the sleeve is rotated. The tool includes a rotatable propelling part for the sleeve and the propelling part has an insertion end to be placed in a chuck of a rotary hammer drill.

Positively locked anchorages are frequently used for attachment devices exposed to high tensile stresses and, in particular, for attachments for safety applications. As a result of the positive engagement, expansion forces are substantially prevented under load. Accordingly, it is possible to maintain small axial spacing and edge spacing as compared with conventional expansion anchors. For positively locked anchorages, undercut anchors are used including an anchor rod with a conical surface widening in the setting direction and an axially displaceable sleeve which slides over the anchor rod. The end of the sleeve facing the conically shaped surface has a number of segments which can be spread radially outwardly into an undercut in a receiving borehole when the sleeve is pushed against the conically shaped surface, thus establishing the positively locked engagement.

In the majority of known undercut anchors, the undercut must be produced before setting the anchor. Formation of the undercut may be carried out with a complicated drilling tool with which the cylindrical receiving borehole and the undercut are produced in one drilling operation. Such drilling tools, however, are less suited for hard receiving materials in which the borehole is formed. Therefore, a cylindrical receiving borehole is usually produced first and then the undercut is made at the desired depth in a separate operation using a special undercutting tool. Only after the undercut is formed can the undercut anchor be inserted into the receiving borehole. Such a process for forming positively locked anchorages is relatively time consuming and requires special tools, such as collar drills for producing a receiving borehole with a defined depth, a special undercutting device and, often, another device for securing the undercut anchor.

To facilitate the production of positively locked anchorages, undercut anchors have been proposed in which the undercut is not formed until the setting operation is carried out. A self-cutting undercut anchor of this type is disclosed in U.S. Pat. No. 4,702,754. In this known undercut anchor, the segments which spread radially outwardly are constructed as cutting tabs with cutting edges at their free leading ends. To form the positively locked anchorage, the undercut anchor is inserted into a cylindrical receiving borehole. The sleeve is displaced axially against the conically shaped surface while it is rotated during the setting operation, with the conically shaped surface being supported at the base of the receiving borehole. As the sleeve is rotated, an undercut is formed in the surface of the borehole by the cutting edges on the cutting tabs which are spread radially outwardly by the displacement of the sleeve in the axial direction. The depth of the undercut increases to the extent that the cutting tabs are spread outwardly. At the end of the setting operation, the undercut anchor is secured in a positively locked engagement.

To set the undercut anchor, a setting tool is used having a sleeve-shaped propelling part inserted into the receiving borehole against the trailing end of the anchor rod and is provided with rotating drivers which engage in correspondingly shaped slots or grooves in the trailing end of the sleeve. At its leading end, a cylindrical shaft is formed integrally with the propelling part, with the shaft formed as an insertion end for the chuck of a rotary hammer drill. The sleeve-shaped propelling part is axially rotated by the drill and transmits the rotating movement to the sleeve. The axial displacement of the sleeve is effected by axial blows directed against the propelling part by the hammer drill. When this known setting device is used, the conically-shaped surface of the anchor rod must be supported at the base of the receiving borehole. Accordingly, the depth of the receiving borehole must be exactly monitored as it is being formed. Special drilling tools having a depth stop, for example, collar drills, are required for such an operation. Another disadvantage is that the conically shaped surface of the anchor rod can dig into the base of the receiving borehole during the setting operation. As a result, the undercut is formed too deeply in the receiving borehole and, in turn, the undercut anchor is set too deeply in the base or receiving material.

SUMMARY OF THE INVENTION

Therefore, the primary object of the present invention is to avoid the disadvantages of the prior art setting devices. A tool or setting device is to be provided for self-cutting undercut anchors whereby the anchor can be secured by a positive engagement at a desired depth independent of the depth of the receiving borehole. The use of collar drills and similar drilling tools using depth stops can be avoided. In particular, the setting device can place self-cutting undercut anchors which are not required to be supported at the base of the receiving borehole. The setting device is simple in construction and use and can be inserted in the chuck of a known rotary hammer drill.

In accordance with the present invention, a setting device or tool for self-cutting undercut anchors has a propelling part cooperating with a support element to be supported by the surface of the receiving material in which the receiving borehole is formed. The support element has a receptacle for the trailing end of the anchor rod for axially fixing the anchor rod. The propelling part is displaceable axially relative to the support element. The setting device or tool is used for placing self-cutting undercut anchors formed of an anchor rod with a conically shaped surface at its leading end and a rotatable sleeve which is displaced axially over the anchor rod and has cutting tabs at its leading end which are spread radially outwardly when the sleeve is driven against the conically shaped surface and forms an undercut in the inside surface of a cylindrical receiving borehole during rotation. The tool has a rotatable propelling part for rotating the sleeve of the undercut anchor and the propelling part has a trailing end for insertion into the chuck of a rotary hammer drill. The propelling part cooperates with the support element supported on the receiving material containing the borehole and the support element has a receptacle for the trailing end of the anchor rod so that the anchor rod can be fixed in the axial direction. The propelling part is axially displaceable relative to the support element.

According to the invention, the setting device can be used for placement of self-cutting undercut anchors in which the anchor rod does not need to be supported at the base of the receiving borehole. The anchor rod is secured in the receptacle of the support element against axial displacement and is prevented from falling into the receiving borehole. The support element is supported in the region of the opening into the receiving borehole at the surface of the receiving material containing the borehole or at the surface of a member to be connected to the receiving material. The propelling part is provided with a cylindrical shaft arranged to be inserted into a chuck in a known rotary hammer drill and is axially displaceable relative to the support element. In this way, axial blows of the hammer drill and the rotation of the chuck are transmitted to the sleeve and can drive the sleeve against the conically shaped surface in both a rotating and axially hammering manner. Accordingly, the cutting tabs are spread radially outwardly and form the undercut in the inside surface of the cylindrical receiving borehole. Since it is no longer necessary to support the anchor rod at the base of the borehole, the anchor rod does not dig into the base and the undercut is formed at the desired depth.

The setting device is constructed in a very simple manner comprising only the propelling part and the support element containing the receptacle for the anchor rod. No special training or safety measures are required for operating the setting device. The anchor rod with the sleeve placed around it need only be inserted into the receptacle and fixed axially to it. Subsequently, the undercut anchor is coupled with the setting tool and can be inserted into the receiving borehole. The propelling part is rotated by a rotary hammer drill with the trailing end of the setting tool inserted into the chuck of the drill, so that axially directed blows are exerted on the propelling part. The axially directed blows drive the sleeve onto the conically shaped surface and the rotating cutting tabs are spread radially outwardly and form the undercut. When the setting operation is completed, it is only necessary to remove the rotary hammer drill from the setting tool and to detach the support element from the anchor rod of the set undercut anchor. The setting tool is then ready to set another self-cutting undercut anchor.

The maximum axial displacement of the propelling part relative to the support element corresponds to the desired displacement of the sleeve along the anchor rod. In this advantageous embodiment of the invention, the operator has direct control over the setting operation. The setting operation is completed only when the propelling part has been displaced axially relative to the support element by the full amount of the displacement path and it is then assured that the cutting tabs have produced the undercut at the desired undercut depth. Moreover, this feature also insures that the displacement of the sleeve is limited and the sleeve is not pushed too far onto the conically shaped surface. As a result, overloading of the cutting tabs is prevented.

To form a centered undercut, the propelling part and the support element are advantageously aligned relative to one another in such a way that the receptacle for the anchor rod is located in the axial extension of the insertion end of the propelling part.

In a particularly simple embodiment of the receptacle for the anchor rod, the receptacle has a bore with an internal thread into which the trailing end of the anchor rod having an external thread can be screwed.

In using the setting tool with undercut anchors having anchor rods of different diameters, the receptacle for the anchor rod is preferably designed as an exchangeable part. In this way, receptacles with different bore diameters can be connected with the support element. If an undercut anchor has an anchor rod with an internally threaded bore, a receptacle with a correspondingly constructed pin can be provided. The setting tool has increased flexibility when the receptacle is constructed as an exchangeable part.

In another preferred embodiment of the invention, the anchor rod is clamped in the receptacle. The clamping action can be effected by a clamping pin extending perpendicularly relative to the anchor rod and it is rotatable about its axis. The clamping pin has a flat or planar surface arranged to be positioned in an edge region of the receptacle and, when directed into the receptacle, the flat surface faces the center of the receptacle, however, when rotated, the clamping pin clamps the anchor rod by a rounded surface projecting into the receptacle.

To transmit rotational movement to the sleeve, the propelling part can be formed with rotation drivers engageable in correspondingly formed grooves and/or projections at the trailing end of the sleeve. In an alternate embodiment of the setting tool, the propelling part and the support element are coupled together so they rotate as a unit. This embodiment is especially suitable for self-cutting undercut anchors in which the anchor rod and the sleeve rotate together. The rotational coupling of the anchor rod and the sleeve of the undercut anchor and of the propelling part and the support element of the setting tool obviates the rotation drivers on the propelling part for the sleeve. The rotating propelling part carries the support element along with it. The anchor rod hole in the receptacle of the support element fixed for rotation with the support element is arranged so that it hovers above the base of the receiving borehole and transmits the rotational movement to the sleeve.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
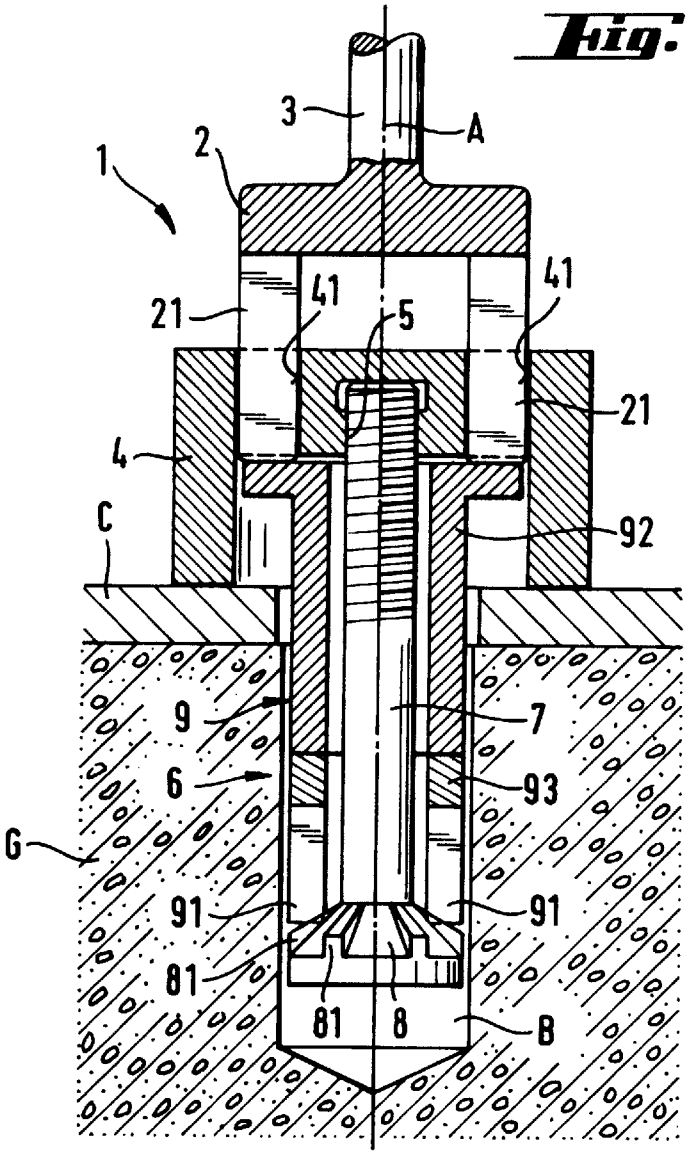
FIG. 1 is an axially extending cross sectional view of a first embodiment of a setting device incorporating the present invention and shown before it sets a self-cutting undercut anchor.
Figure 2:
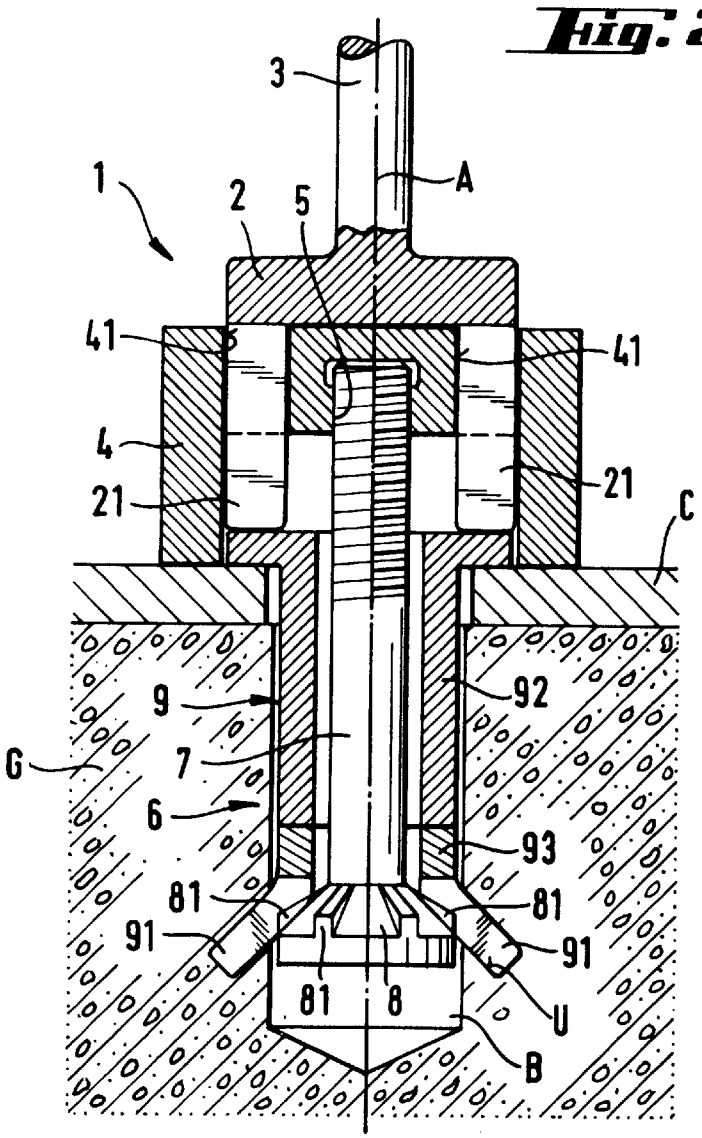
FIG. 2 shows the setting device as set forth in FIG. 1 after the undercut anchor has been set.

FIGS. 1 and 2 are schematic views of a first embodiment of the setting tool of the present invention in combination with an undercut anchor to be anchored. In FIG. 1 the anchoring operation has not been carried out, while in FIG. 2 the anchoring operation has been completed. The setting tool 1 includes an axially extending propelling part 2 including an axially extending shaft 3 extending rearwardly in FIGS. 1 and 2. The shaft 3 at its trailing or upper end, not shown, is arranged to be inserted into a chuck or tool holder of a rotary hammer drill, not shown, such a hammer drill is a product of the assignee. In addition, the setting tool has an axially extending sleeve-like support element 4 shown supported on the surface of a component part C bearing against the surface of a receiving material G. In FIG. 1 an undercut anchor 6 is shown inserted into a borehole B in the receiving material G, however, it has not yet been expanded into the undercut position. The undercut anchor 6 is self-cutting and produces an undercut U in the inner surface of the cylindrical borehole B during the setting operation. The self-cutting undercut anchor 6 includes an axially extending anchor rod 7 having a leading end, the lower end in FIGS. 1 and 2 and a trailing end, the upper end in FIGS. 1 and 2. At its leading end, the anchor rod has a conically shaped surface 8 widening in the setting direction, that is, the direction towards the base of the borehole B. An axially extending sleeve 9 laterally encloses the anchor rod and has a leading end, the lower end, and a trailing end, the upper end. The sleeve is displaceable along the anchor rod in the direction of the axis A of the undercut anchor towards the base of the borehole B. At its leading end facing the conically shaped surface 8, the sleeve 9 has axially extending cutting tabs 91 with cutting edges and the tabs are spread radially outwardly when the sleeve is displaced axially against the conically shaped surface. The cutting edges can be hard metal inserts or hard metal pins or hardened projections such as welds or hardened metal pieces welded onto the leading ends or free ends of the cutting tabs 91. While the sleeve can be formed in one piece, it can also be formed of two axially extending sleeve sections, as is shown in the drawing. In the illustrated arrangement, the leading sleeve section is a cutting sleeve section 93 containing the cutting tabs, while the trailing sleeve section 92 is formed as a thrust sleeve whose length can vary in accordance with the length of the anchor rod 7.

As shown in FIGS. 1 and 2, the anchor rod is fixed axially in a receptacle 5 in the support element 4. In particular, the axial arrangement of the setting tool 1 is shown by way of example so that the anchor rod 7 is held in a spaced manner above the base of the borehole B. The propelling part 2 is displaceable axially relative to the support element 4. In this regard, the maximum axial displacement path of the propelling part preferably corresponds to the desired displacement path of the sleeve 9 along the anchor rod 7. In the embodiment shown in FIGS. 1 and 2, the propelling part 2 and the support element 4 are coupled for rotation. Accordingly, axial projections 21 on the propelling part 2 extend axially through openings 41 in the sleeve-like support element 4. When the propelling part 2 rotates, the support element 4 is rotated along with it. Anchor rod 7 is axially fixed in the receptacle 5 of the support element 4 and is coupled with the support element so that it will rotate along with it. As a result, the anchor rod 7 rotates with the support element 4 about the axis A. At its leading end, the anchor rod has rib-like rotation drivers 81 formed on the conically shaped surface 8 which engage in intermediate spaces between the cutting tabs 91 and transmit rotational movement to the sleeve 9 or at least to the cutting sleeve section 93.

While the anchor rod 7 and sleeve 9 are rotated, axial blows are directed against the propelling part 2 by the striking mechanism of the rotary hammer drill. The propelling part 2 acts as an intermediate anvil and transmits the axial blows to the cutting sleeve 93 via the axial projections 21 contacting the trailing end of the sleeve 9 and the thrust sleeve section 92. The propelling part 2 is displaced in the axial or setting direction by the axially directed blows and the sleeve 9 or the cutting sleeve section 93 is displaced against the conically shaped surface 8 on the leading end of the anchor rod 7 which is fixed in the axial direction, so that it remains spaced from the base of the borehole B. As a result, the cutting tabs 91 are spread radially outwardly. Due to the simultaneous rotation, the cutting edges at the leading ends of the cutting tabs 91 form an undercut U in the wall surface of the cylindrical borehole B. The setting procedure is completed when the propelling part is displaced along the full axial path relative to the support element 4, note the movement of the propelling part as shown in FIG. 2 as compared to FIG. 1. This feature allows the operator to monitor the setting procedure for determining whether or not the cutting tabs 91 have spread outwardly to the desired extent and the undercut U has the desired depth. At the conclusion of the setting procedure, the undercut anchor 6 is anchored in the receiving borehole B in a positively locked engagement. With the anchor 6 completely secured, the setting tool 1 is removed from the anchor rod and is ready to carry out the fixed engagement of another self-cutting undercut anchor.

Figure 3:
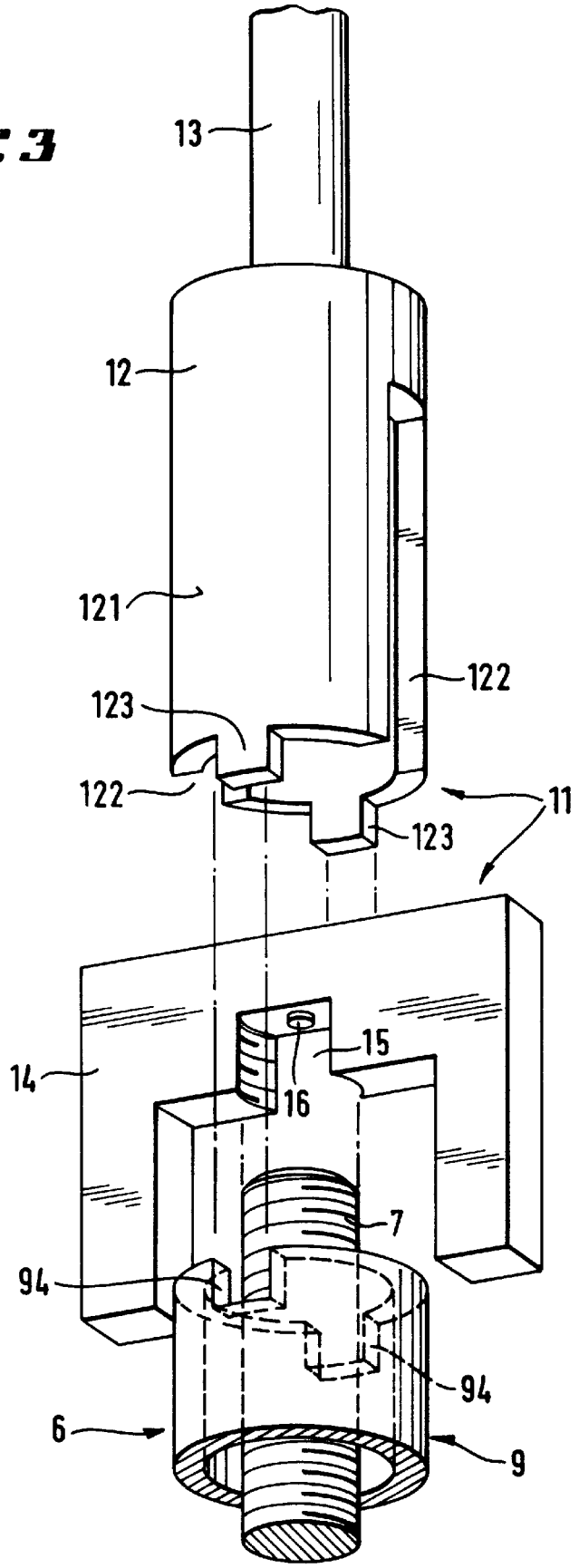
FIG. 3 displays a perspective exploded view of a second embodiment of the setting tool.

In FIG. 3 a second embodiment of a setting tool 11 is illustrated. The setting tool 11 is formed of an axially extending propelling part 12 with an insertion end 13 at its trailing end. Propelling part 12 has an axially extending sleeve-like cylindrical section 121 with two axially extending slits 122 extending from its leading end, that is the lower end as viewed in FIG. 3, toward its trailing end. The axial slits 122 are located diametrically opposite one another and are open at the leading end of the sleeve-like section 121. Axial slits 122 in propelling part 12 fit downwardly over a support element 14 which is shaped as a flat U-shaped stirrup. The axial length of the slits 122 determines the maximum displacement path of the propelling part 12. The outside diameter of the cylindrical section 121 corresponds to the outside diameter of the sleeve 9 of the undercut anchor to be set. Support element 14 has a receptacle 15 in a downwardly facing surface as viewed in FIG. 3 for receiving the anchor rod 7 of the self-cutting undercut anchor 6. The receptacle 15 is formed as a notch in the support element 14 in the part of the element extending transversely of the axial direction adjacent the upper or trailing end of the support element. The receptacle 15 has an internal thread for engagement with an external thread on the trailing end of the anchor rod 7. The receptacle 15 has a stop face 16 at its base for supporting the trailing end of the anchor rod. Grooves 94 are provided in the trailing end of the sleeve 9 of the undercut anchor. The grooves 94 are arranged to receive the axial projections 123 located on the leading end of the cylindrical section 121 of the propelling part 12. In the embodiment displayed in FIG. 3, the rotational movement of the propelling part is transmitted directly to the sleeve by the axial projections 123 at the leading end of the cylindrical section 121 engaged in the grooves 94 in the sleeve 9. The only function of the support element 14 in this arrangement is to fix the axial anchor rod 7 in the axial direction. The embodiment shown in FIG. 3 is suitable for undercut anchors which do not have any rotation drivers for the sleeve on the conically shaped surface.

Figure 4:
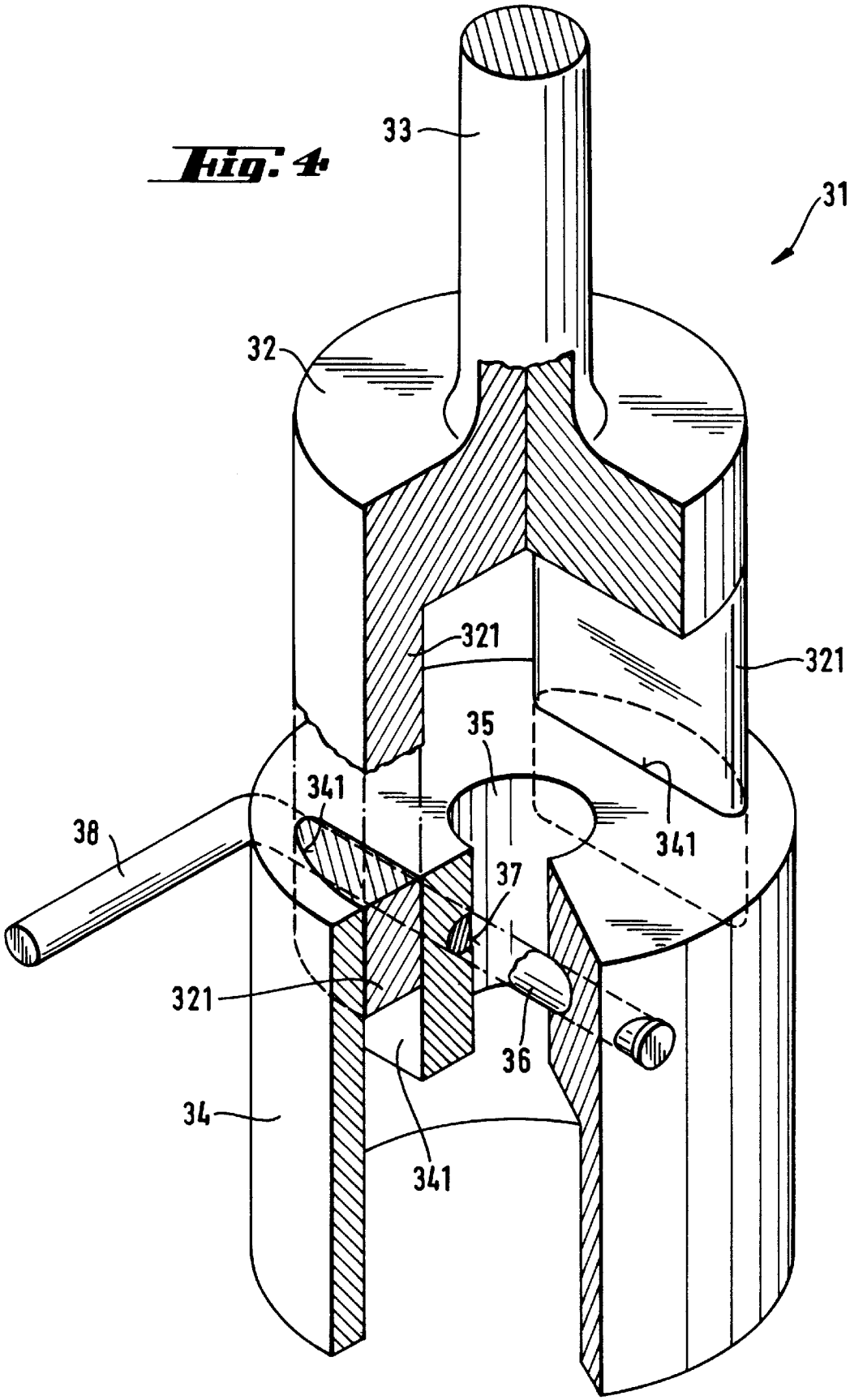
FIG. 4 exhibits a third embodiment of the setting device, shown partly in cross section.

Another embodiment of the invention is illustrated in FIG. 4 in partial axial section. The setting tool 31 comprises a propelling part 32 and a support element 34 with the propelling part being axially displaceable relative to the support element. Propelling part 32 has a cylindrical shaft 33 extending axially rearwardly in FIG. 4 and forming an insertion end for the chuck of a rotary hammer drill. The propelling part 32 and the support element 34 are coupled so that they rotate together. Accordingly, propelling part 32 has at its leading end axially projecting claws 321 extending into similarly shaped openings 341 in the trailing end of the support element. A receptacle 35 for the trailing end of the anchor rod 7 is formed by an axial bore in the support element. A clamping pin 36 extends transversely of the axial direction of the tool through an opening traversing the peripheral edge region of the borehole 35 and is supported in the support element so that it can be rotated. The clamping pin 36 has a lever 38 at one end located outside of the support element 34. Clamping pin 36 is a round member with a flat section 37 which can be swiveled into the borehole 35 so that the borehole is open or in an unlocked position with respect to the anchor rod, not shown. When the clamping pin 36 is swiveled or pivoted from the position shown in FIG. 4, the flat section 37 is displaced out of the borehole and the round surface of the pin reduces the diameter of the borehole. In this position, an anchor rod inserted in the borehole 35 is fixed axially and is connected with the support element 34 for rotation with it. Since the anchor rod is fixed by a clamping action, anchor rods without external threads can be inserted into the receptacle 35 and secured against axial movement while connected to the support element 34 so that the two parts rotate together. The embodiment of the setting tool shown in FIG. 4 functions in the same manner as the embodiment displayed in FIGS. 1 and 2.

The setting tool embodying the present invention affords reliable anchoring of self-cutting undercut anchors without the need for producing a receiving borehole with a predetermined depth. This permits the tool user with flexibility as concerns the setting depth of the positively locked anchor. The anchor rod does not need to be supported at the base of the borehole during the setting operation and, accordingly, is no longer able to dig into the base. The setting device is simple with regard to its construction and application and can be used with known rotary hammer drills, such as the hammer drills available from the assignee which can also be used to produce the cylindrical receiving borehole.

While specific embodiments of the invention have been shown and described in detail to illustrate the inventive principles, it will be understood that the invention may be embodied otherwise without departing from such principles.

We claim:

1. A tool for setting a self-cutting undercut anchor (6) where the undercut (U) is formed by an axially extending anchor rod (7) having a leading end to be inserted first into a borehole (B) in a receiving material (G) for receiving the anchor rod, a trailing end and a setting direction extending from the trailing end towards the leading end, the leading end of the anchor rod having a conically shaped surface (8) widening in the setting direction, and an axially extending rotatable sleeve (9) encircling the anchor rod and having a leading end and a trailing end and being insertable into the borehole (B), the leading end of said sleeve having axially extending cutting tabs (91) spreadable radially outwardly when said sleeve is rotated and axially displaced in the setting direction into contact with the conically shaped surface (8) and forming an undercut (U) in a laterally enclosing wall surface of the borehole (B), said tool comprising an axially extending rotatable propelling part (2, 12, 32) for said sleeve (9) of the undercut anchor (6), said propelling part having a leading end and a trailing end with an insertion end (3, 13, 33) at the trailing end thereof for insertion into a chuck of a rotary hammer drill for rotating and axially displacing said propelling part in the setting direction, an axially extending support element (4, 14, 34) arranged to interengage said propelling part and to be supported in the setting direction by a surface of the receiving material (G) into which the borehole (B) is formed, said support element (4, 14, 34) having a receptacle (5, 15, 35) for receiving and axially fixing the trailing end of said anchor rod, and said propelling part (2, 12, 32) being axially displaceable relative to said support element with said support element held against axial displacement by the surface of the receiving material as said propelling part is rotated and axially displaced, so that the sleeve of the undercut anchor is rotated and driven axially in the setting direction against the conically shaped surface (8) for rotating and axially displacing the cutting tabs on the sleeve for forming the undercut in the borehole.

2. A tool, as set forth in claim 1 wherein said propelling part (2, 12, 32) having a maximum axial displacement path relative to said support element (4, 14, 34) corresponding to a required displacement path of said sleeve (9) relative to said anchor rod (7).

3. A tool, as set forth in claim 1 or 2, wherein said propelling part (2, 12, 32) and said support element (4, 14, 34) being axially aligned relative to one another so that said receptacle (5, 15, 35) for the anchor rod (7) is arranged in an axial extension of said insertion end (3, 13, 33) of said propelling part.

4. A tool, as set forth in claim 3, wherein said receptacle (5, 15) for the anchor rod (7) has an axially extending bore with an internal thread into which the trailing end of the anchor rod (7) provided with an external thread can be screwed.

5. A tool, as set forth in claim 4, wherein said receptacle (5, 15) for the anchor rod (7) is exchangeable.

6. A tool, as set forth in claim 1 or 2, wherein a clamping arrangement (36, 37, 39) is located in said support element traversing an axially extending bore in said receptacle (35) and said clamping arrangement being displaceable between a first position for axially clamping the anchor rod (7) and a second position for releasing the clamping of the anchor rod.

7. A tool, as set forth in claim 1 or 2, wherein said propelling part (12) having rotation drivers (123) thereon arranged to engage in correspondingly shaped grooves (94) at a trailing end face of said sleeve (9).

8. A tool, as set forth in claim 1 or 2, wherein said propelling part (2, 12, 32) and said support element (4, 14, 34) being coupled together for rotation as a unit.

9. A tool, as set forth in claim 8, wherein the anchor rod (7) fixed in the receptacle (5, 35) of said support element (4, 34) and the sleeve (9) of the undercut anchor (6) are coupled together for rotation with one another.

10. A tool and anchor assembly comprising a self-cutting undercut anchor (6) where the undercut anchor is formed of an axially extending anchor rod (7) having a leading end to be inserted first into a bore hole (B) in a receiving material (G) for receiving the anchor rod, a trailing end and a setting direction extending from the trailing end toward the leading end, the leading end of said anchor rod having a conically shaped surface (8) widening in the setting direction, and an axially extending rotatable sleeve (9) encircling the anchor rod and having a leading end and a trailing end and being insertable into the bore hole (B), the leading end of said sleeve having axially extending cutting tabs (91) spreadable radially outwardly when said sleeve and faxing in a direction of rotation of said sleeve is rotated and axially displaced in the setting direction into contact with the conically shaped surface, said cutting tabs (91) having cutting edges extending in the axial direction of said sleeve for forming an undercut (U) in a laterally enclosing wall surface of the bore hole (B), said tool comprising an axially extending rotatable propelling part (2, 12, 32) for said sleeve (9) of the undercut anchor (6), said propelling part having a leading end and a trailing end with an insertion (3, 13, 33) at the trailing end thereof for insertion into a chuck of a rotary hammer drill for rotating and axially displacing said propelling part in the setting direction, an axially extending support element (4, 14, 34) arranged to interengage said propelling part and to be supported in the setting direction by a surface of the receiving material (G) into which the bore hole (B) is formed, said support element (4, 14, 34) having a receptacle (5, 15, 35) for receiving and axially fixing the trailing end of said anchor rod, and said propelling part (2, 12, 32) being axially displaceable relative to said support element with said support element held against axial displacement by the surface of the receiving material as said propelling part is rotated and axially displaced so that the sleeve of the undercut anchor is rotated and driven axially in the rotating direction against the conically shaped surface (8) for rotating and axially displacing the cutting tabs on the sleeve for forming the undercut in the bore hole.

* * * * *